US008473185B2

(12) United States Patent
Suwa et al.

(10) Patent No.: US 8,473,185 B2
(45) Date of Patent: Jun. 25, 2013

(54) SYSTEM AND METHOD FOR DETECTING ENGINE OIL AERATION AND STARVATION BASED ON ENGINE VIBRATION

(75) Inventors: Yujiro Suwa, Cammerce Township, MI (US); Alan S. Miller, Farmington Hills, MI (US); Robert W. Riegel, Shelby Township, MI (US)

(73) Assignee: GM Global Technology Operations LLC

( * ) Notice: Subject to any disclaimer, the term of this patent is extended or adjusted under 35 U.S.C. 154(b) by 504 days.

(21) Appl. No.: 12/858,681

(22) Filed: Aug. 18, 2010

(65) Prior Publication Data

US 2012/0046848 A1 Feb. 23, 2012

(51) Int. Cl.
*F02D 28/00* (2006.01)
*G06F 19/00* (2011.01)

(52) U.S. Cl.
USPC ..... 701/111; 123/406.18; 123/406.21

(58) Field of Classification Search
USPC ..... 701/111, 101, 102, 47, 44, 59, 29.5; 123/196 S, 406.21, 406.18, 406.29, 406.38
See application file for complete search history.

(56) References Cited

U.S. PATENT DOCUMENTS 5,912,821 A * 6/1999 Kobayashi ..... 701/111
7,620,188 B2 * 11/2009 Inoue et al. ..... 123/192.1
8,027,484 B2 * 9/2011 Yoshida et al. ..... 381/71.4
8,099,231 B1 * 1/2012 Suwa ..... 701/111

OTHER PUBLICATIONS

U.S. Appl. No. 12/858,693, filed Aug. 18, 2010, Yujiro Suwa.

* cited by examiner

*Primary Examiner* — Hieu T Vo

(57) ABSTRACT

An engine control system includes a determination module and a detection module. The determination module, based on an engine vibration signal generated by an engine vibration sensor, determines a frequency of engine vibration and determines a crankshaft position corresponding to the engine vibration. The detection module detects engine oil aeration and starvation when the frequency and crankshaft position are greater than predetermined thresholds, respectively.

20 Claims, 3 Drawing Sheets

SYSTEM AND METHOD FOR DETECTING ENGINE OIL AERATION AND STARVATION BASED ON ENGINE VIBRATION

CROSS-REFERENCE TO RELATED APPLICATIONS

This application is related to U.S. patent application Ser. No. 12/858,693 filed on Aug. 18, 2010. The disclosure of the above application is incorporated herein by reference in its entirety.

FIELD

The present disclosure relates to internal combustion engines and more particularly to a system and method for detecting engine oil aeration and starvation based on engine vibration.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air/fuel (A/F) mixture within cylinders to generate drive torque. The combustion of the A/F mixture drives pistons that rotatably turn a crankshaft generating the drive torque. The drive torque may be transferred to a driveline (e.g., wheels) of a vehicle via a transmission. Lubricants (e.g., oil) may lubricate moving engine components to protect the components from damage (e.g., due to friction). For example, oil may be pumped into bearings of the engine from an oil sump.

The entrapment of air in engine oil may be referred to as "aeration." Engine oil aeration may occur when the engine oil is being circulated at a high rate (e.g., high engine speeds) where there is less time for air bubbles to escape the engine oil. Additionally, engine oil aeration may increase as engine oil temperature decreases. Engine oil aeration may affect combustion and may thereby damage engine components and/or decrease engine performance. Similarly, low engine oil levels (e.g., less than a critical amount of engine oil)—also referred to as "starvation"—may damage engine components and/or decrease engine performance.

SUMMARY

An engine control system includes a determination module and a detection module. The determination module, based on an engine vibration signal generated by an engine vibration sensor, determines a frequency of engine vibration and determines a crankshaft position corresponding to the engine vibration. The detection module detects engine oil aeration and starvation when the frequency and crankshaft position are greater than predetermined thresholds, respectively.

A method includes determining a frequency of engine vibration based on an engine vibration signal generated by an engine vibration sensor, determining a crankshaft position corresponding to the engine vibration based on the engine vibration signal generated by the engine vibration sensor, and detecting engine oil aeration and starvation when the frequency and crankshaft position are greater than predetermined thresholds, respectively.

In still other features, the systems and methods described above are implemented by a computer program executed by one or more processors. The computer program can reside on a tangible computer readable medium such as but not limited to memory, nonvolatile data storage, and/or other suitable tangible storage mediums.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
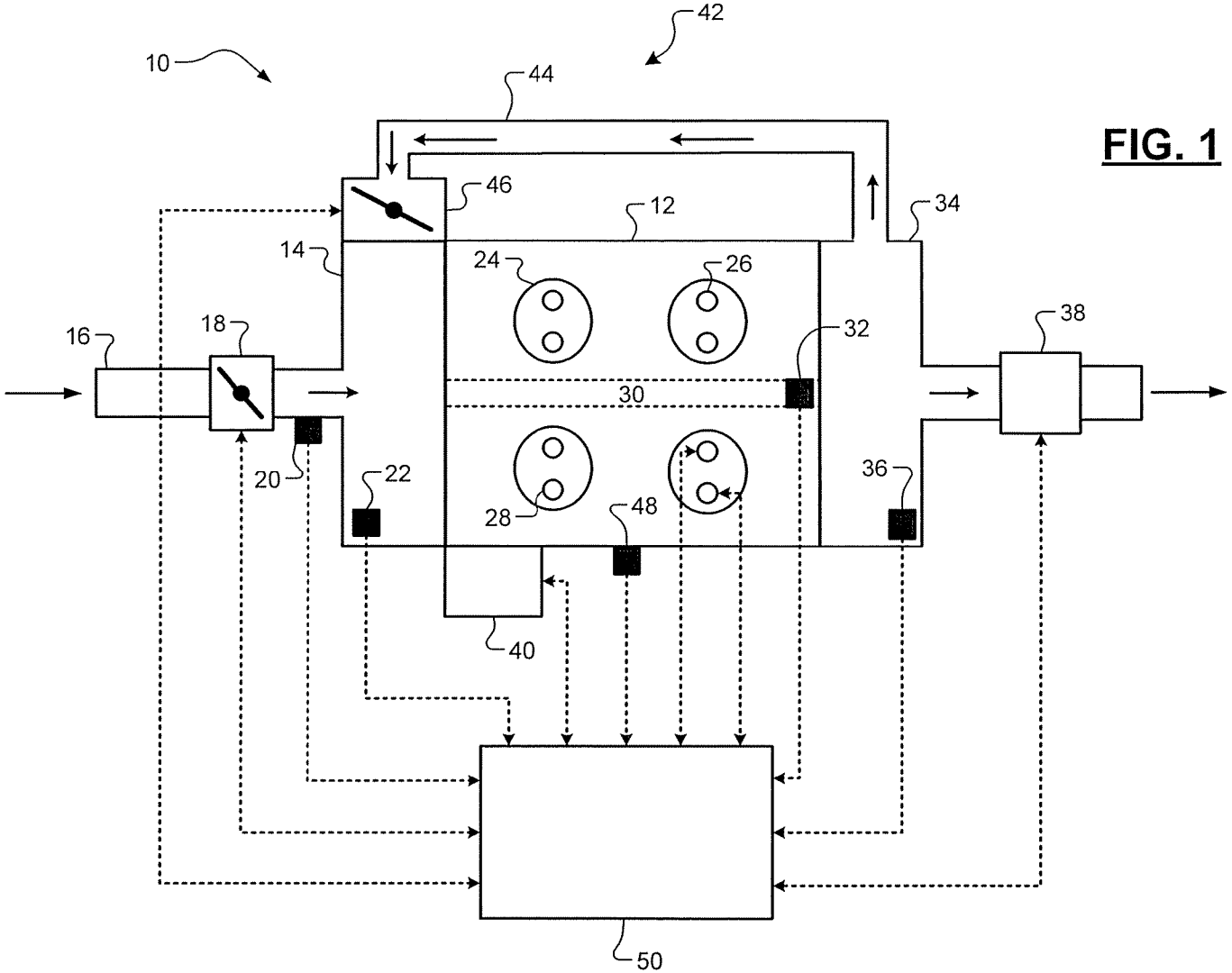
FIG. 1 is a functional block diagram of an exemplary engine system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Engine oil starvation may damage engine components due to insufficient lubrication (i.e., increased friction). Engine oil starvation, however, may be difficult and/or costly to detect. More specifically, implementing engine oil pressure sensors and/or engine oil level sensors may increase costs and may be difficult to implement. For example, placement (i.e., location) of the sensor(s) may affect whether engine oil starvation is detected (e.g., variable detection performance).

Engine oil level (and thus engine oil starvation) is related to engine oil aeration. More specifically, engine oil aeration may occur at low engine oil levels. For example, engine oil aeration may occur during engine oil starvation (i.e., engine oil level less than a threshold) and when the engine is tilted (e.g., when a vehicle is traversing a corner). Engine oil aeration, however, may be detected based on engine vibration. For example, an increase in engine vibration may indicate engine oil aeration.

Accordingly, a system and method are presented that detect engine oil aeration and starvation based on engine vibration. For example, the engine vibration may be determined or measured based on an engine vibration signal generated by an engine knock sensor, an accelerometer, or another suitable sensor. Specifically, the system and method may determine a location and frequency of the engine vibration using the engine vibration signal. For example, the engine vibration location may include a crank angle (e.g., crank angle degree, or CAD) corresponding to a maximum intensity of the engine vibration signal. Additionally, for example, the engine vibration frequency may be based on digital signal processing (DSP) of the engine vibration signal (e.g., a maximum of a fast Fourier transform, or FFT).

The system and method may then detect engine oil aeration (and thus engine oil starvation) based on the determined location and frequency of the engine vibration. For example, the system and method may detect engine oil aeration and starvation when the determined location (e.g., crank angle) and frequency of the engine vibration signal are greater than predetermined thresholds, respectively. For example, the predetermined thresholds may correspond to normal engine operation. Thus, a determined location and frequency greater than the predetermined thresholds may indicate abnormal engine operation.

Additionally or alternatively, the system and method may also estimate an engine oil level. More specifically, the system and method may estimate the engine oil level based on the detection of engine oil aeration/starvation and the measured engine vibration (i.e., location and frequency). In other words, the detection of engine oil aeration/starvation may indicate a predetermined engine oil level (e.g., a low oil level threshold). Moreover, however, the system and method may then estimate the engine oil level (i.e., determine how far the engine oil level is below the low oil level threshold) based on the location and/or frequency of the engine vibration. For example, the estimated engine oil level may decrease when the location and/or frequency of the engine vibration increases.

The system and method may also generate an error signal when engine oil aeration/starvation is detected. For example, the error signals may notify a driver of the vehicle of the detected problem and/or may modify engine operation to reduce or prevent damage to engine components. Additionally, the system and method may modify engine operation based on the detection of engine oil aeration/starvation and/or the estimated engine oil level (e.g., to reduce or prevent damage to the engine).

Referring now to FIG. 1, an engine system 10 includes an engine 12. For example, the engine 12 may include a spark ignition (SI) combustion engine, a compression ignition (CI) engine (e.g., a diesel engine), or a homogeneous charge compression ignition (HCCI) engine. The engine system 10, however, may also include a different type of engine and/or additional components, such as in a hybrid engine system (e.g., an electric motor).

The engine 12 draws air into an intake manifold 14 through an inlet system 16 that may be regulated by a throttle 18. For example, the throttle 18 may be electronically controlled (e.g., electronic throttle control, or ETC). A mass air flow (MAF) sensor 20 may measure a MAF rate into the intake manifold 14. A manifold absolute pressure (MAP) sensor 22 may measure a pressure of air inside the intake manifold 14. The air in the intake manifold 14 may be distributed to a plurality of cylinders 24. While four cylinders are shown, other numbers of cylinders may be implemented.

The air in the cylinders 24 may be mixed with fuel from a plurality of fuel injectors 26 to create an air/fuel (A/F) mixture. For example, the fuel injectors 26 may inject fuel via intake ports of the cylinders 24, respectively (e.g., port fuel injection), or directly into the cylinders 24, respectively (e.g., direct fuel injection). Combustion of the A/F mixture drives pistons (not shown) which rotatably turn a crankshaft 30 generating drive torque. An engine speed sensor 32 may measure a rotational speed of the crankshaft 30 (e.g., in revolutions per minute, or RPM). The drive torque may be transferred from the crankshaft 30 to a driveline (not shown) of the vehicle (e.g., wheels) via a transmission (not shown). For example, the transmission (not shown) may be coupled to the crankshaft 30 via a torque converter (e.g., a fluid coupling).

Specifically, in SI combustion engines, the A/F mixture may be compressed within the cylinders 24 by the pistons (not shown) and combusted via spark from a plurality of spark plugs 28. In HCCI engines, on the other hand, the A/F mixture may be compressed within the cylinders 24 by the pistons (not shown) until a critical pressure and/or temperature is reached and the A/F mixture automatically combusts. Additionally, the spark plugs 28 may "assist" combustion of the A/F mixture in HCCI engines. Furthermore, in CI engines (e.g., diesel engines), the air in the cylinders 24 may be compressed by the pistons (not shown) and fuel may be injected by the fuel injectors 26 into the compressed air (e.g., direct fuel injection) causing the compressed A/F mixture to combust.

Exhaust gas resulting from combustion may be expelled from the cylinders 24 into an exhaust manifold 34. An exhaust back pressure (EBP) sensor 36 may measure a pressure of exhaust gas in the exhaust manifold 34. An exhaust treatment system 38 may treat the exhaust gas to decrease emissions before the exhaust gas is released into the atmosphere. The exhaust gas may also be used to power a turbocharger 40. The turbocharger 40 may increase ("boost") the MAP by compressing the air drawn into intake manifold 14, which may result in increased drive torque (i.e., when combined with more fuel)

Additionally, exhaust gas may be introduced into the intake manifold 14 via an exhaust gas recirculation (EGR) system 42. The EGR system 42 may include an EGR line 44 that connects the exhaust manifold 34 to the intake manifold 14 and an EGR valve 46 that regulates an amount of exhaust gas introduced into the intake manifold 14. Specifically, the EGR system 42 may be used to regulate a ratio of the A/F mixture and/or combustion phasing (e.g., via temperature control). For example, the EGR system 42 may be implemented in CI engines (e.g., diesel engines) and HCCI engines.

An engine vibration sensor 48 measures engine vibration. For example, the engine vibration sensor 48 may include an engine knock sensor, an accelerometer, or another suitable sensor. Additionally, for example, the engine vibration sensor 48 may include a digital engine vibration sensor. The vibration of the engine 12 may be due to combustion noise. In other words, combustion noise may be caused by changes in combustion characteristics (e.g., A/F ratio, spark timing, etc.). The combustion noise, however, may also be caused by changes in pressure in one or more cylinders 24 of the engine 12.

A control module 50 receives signals from the throttle 18, the MAF sensor 20, the MAP sensor 22, the fuel injectors 26, the spark plugs 28, the engine speed sensor 32, the EBP sensor 36, exhaust treatment system 38, the turbocharger 40, the EGR valve 46, and/or the engine vibration sensor 48. The control module 50 may control the throttle 18 (e.g., ETC), the fuel injectors 26, the spark plugs 28, the exhaust treatment system 38, and/or the EGR valve 46. The control module 50 may also implement the system or method of the present disclosure.

Figure 2:
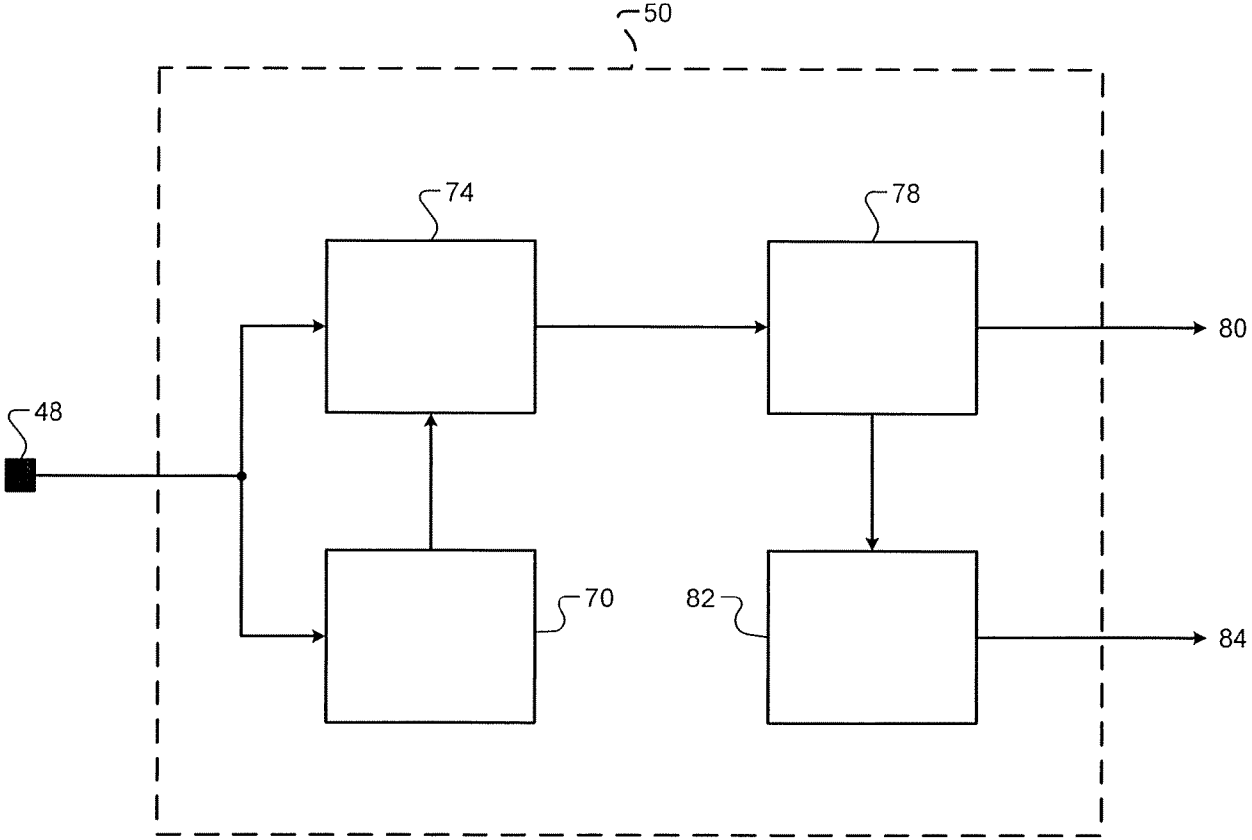
FIG. 2 is a functional block diagram of an exemplary control module according to the present disclosure.

Referring now to FIG. 2, the control module 50 is shown in more detail. The control module 50 may include a digital signal processing (DSP) module 70, a determination module 74, a detection module 78, and an estimation module 82. The control module 50 and/or the other sub-modules of the control module 50 may also include memory (not shown) that stores determined and predetermined parameters. For example, the memory (not shown) may include non-volatile memory (NVM).

The DSP module 70 receives the engine vibration signal from the engine vibration sensor 48. The DSP module 70 processes the engine vibration signal. More specifically, the DSP module 70 may perform digital signal processing (DSP) on the engine vibration signal. For example, the DSP module 70 may generate a fast Fourier transform (FFT) of the engine vibration signal. The DSP module 70, however, may also perform additional or alternative signal processing (e.g., filtering, smoothing, etc.).

The determination module 74 receives the engine vibration signal and the processed engine vibration signal (e.g., the FFT). The determination module 74 may determine a location and frequency of the engine vibration based on the engine vibration signal and the processed engine vibration signal, respectively. More specifically, the determination module 74 may determine the location of the engine vibration based on a maximum engine vibration intensity (i.e., magnitude) during a period. For example, the location may include an angular position of the crankshaft 30 (e.g., a crank angle). Additionally, the determination module 74 may determine the frequency of the engine vibration based on the processed engine vibration signal. For example, the frequency of the engine vibration may be based on a maximum of the FFT.

The detection module 78 receives the determined location and frequency of the engine vibration from the determination module 74. The detection module 78 may detect engine oil aeration (and engine oil starvation) based on the determined location and frequency of the engine vibration. For example, the detection module 78 may detect engine oil aeration/starvation when the determined location and frequency of the engine vibration are greater than predetermined thresholds, respectively. The detection module 78 may also generate an error signal when engine oil aeration/starvation is detected. The error signal may notify the driver of the vehicle and/or modify engine operation to reduce or prevent damage. The detection of engine oil aeration/starvation and/or the error signal may be represented by signal 80.

The estimation module 82 communicates with the detection module. The estimation module 82 may receive a signal indicating whether engine oil aeration/starvation was detected. The estimation module 82 may estimate the engine oil level based on the detection of engine oil aeration/starvation and the location and/or frequency of the engine vibration. More specifically, the detection of engine oil aeration/starvation may indicate a predetermined engine oil level (e.g., a low oil level threshold). Moreover, however, the system and method may then estimate the engine oil level (i.e., determine how far the engine oil level is below the low oil level threshold) based on the location and/or frequency of the engine vibration. For example, the estimated engine oil level may decrease when the location and/or frequency of the engine vibration increases. The estimation module may also generate an error signal the estimated engine oil level is less than a predetermined (e.g., critical) threshold. The error signal may notify the driver of the vehicle and/or modify engine operation to reduce or prevent damage. The estimation of the engine oil level and/or the error signal may be represented by signal 84.

Figure 3:
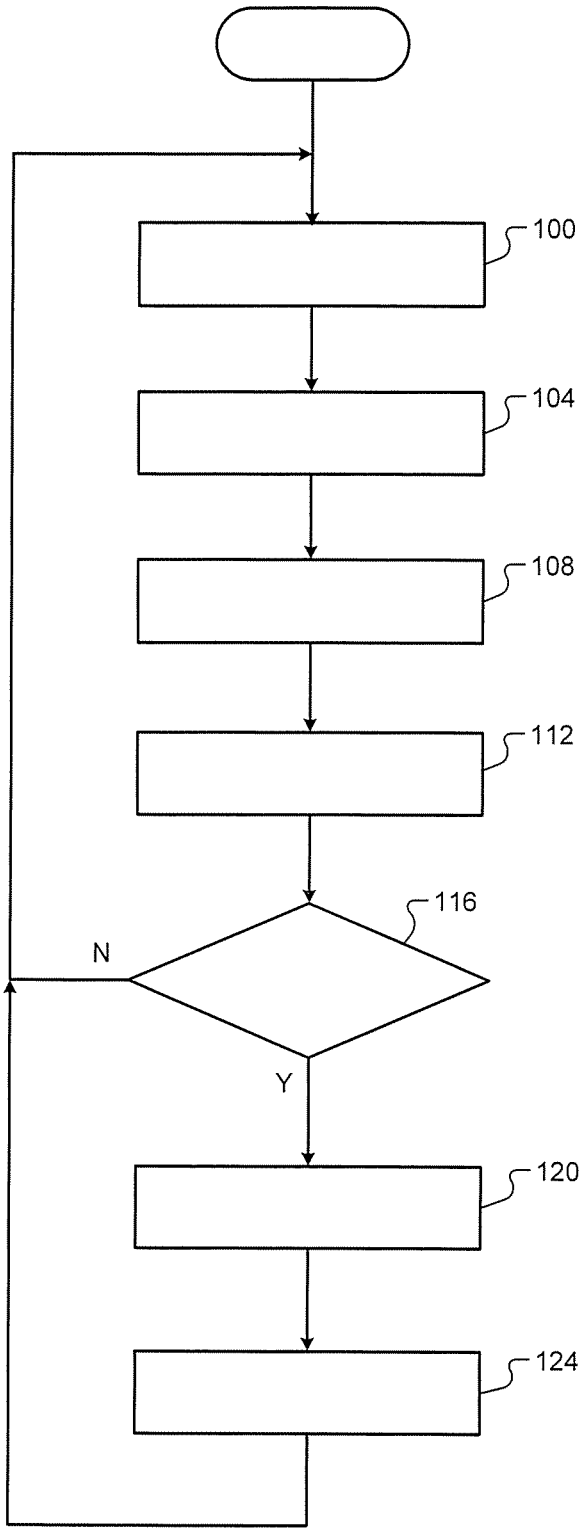
FIG. 3 is a flow diagram of an exemplary method for detecting engine oil aeration and starvation based on engine vibration according to the present disclosure.

Referring now to FIG. 3, a method for detecting engine oil aeration using the engine vibration sensor 48 begins at 100. At 100, the control module 50 measures engine vibration by receiving the engine vibration signal from the engine vibration sensor 48. At 104, the control module 50 processes the engine vibration signal (e.g., generates an FFT). At 108, the control module 50 determines the location (e.g., crank angle) of the engine vibration.

At 112, the control module 50 determines the frequency of the engine vibration. At 116, the control module 50 detects engine oil aeration/starvation. More specifically, the control module 50 may determine whether the determined location and frequency of the engine vibration are greater than predetermined thresholds, respectively. If true, control may proceed to 120. If false, control may return to 100.

At 120, the control module 50 estimates the engine oil level. More specifically, the control module 50 may estimate the engine oil level based on the detection of engine oil aeration/starvation and the location and/or frequency of the engine vibration. At 124, the control module 50 may notify the driver of the vehicle and/or modify engine operation due to engine oil aeration/starvation (or critical engine oil level). Control may then return to 100.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An engine control system, comprising:

a determination module that, based on an engine vibration signal generated by an engine vibration sensor, determines a frequency of engine vibration and determines a crankshaft position corresponding to the engine vibration; and a detection module that detects engine oil aeration and starvation when the frequency and crankshaft position are greater than predetermined thresholds, respectively.

2. The engine control system of claim 1, further comprising:

an estimation module that estimates an engine oil level based on the detection of engine oil aeration and starvation and at least one of the frequency and crankshaft position.

3. The engine control system of claim 1, wherein the detection module detects engine oil aeration when the frequency and crankshaft position are greater than the predetermined thresholds, respectively, and wherein the detection module detects engine oil starvation when engine oil aeration is detected.

4. The engine control system of claim 1, wherein the detection module generates an error signal when engine oil aeration and starvation are detected.

5. The engine control system of claim 4, wherein the error signal at least one of notifies a driver and modifies operation of the engine.

6. The engine control system of claim 1, wherein the crankshaft position is based on a maximum intensity of the engine vibration during a period.

7. The engine control system of claim 1, wherein the engine vibration sensor is one of an engine knock sensor and an accelerometer.

8. The engine control system of claim 1, further comprising:

a digital signal processing (DSP) module that processes the engine vibration signal.

9. The engine control system of claim 8, wherein the DSP module generates a fast Fourier transform (FFT) of the engine vibration signal.

10. The engine control system of claim 9, wherein the frequency of the engine vibration is based on a maximum of the FFT.

11. A method, comprising:

determining a frequency of engine vibration based on an engine vibration signal generated by an engine vibration sensor;

determining a crankshaft position corresponding to the engine vibration based on the engine vibration signal generated by the engine vibration sensor; and detecting engine oil aeration and starvation when the frequency and crankshaft position are greater than predetermined thresholds, respectively.

12. The method of claim 11, further comprising estimating an engine oil level based on the detection of engine oil aeration and starvation and at least one of the frequency and crankshaft position.

13. The method of claim 11, wherein engine oil aeration is detected when the frequency and crankshaft position are greater than the predetermined thresholds, respectively, and engine oil starvation is detected when engine oil aeration is detected.

14. The method of claim 11, further comprising generating an error signal when engine oil aeration and starvation are detected.

15. The method of claim 14, further comprising, based on the error signal, at least one of notifying a driver and modifying operation of the engine.

16. The method of claim 11, wherein the crankshaft position is based on a maximum intensity of the engine vibration during a period.

17. The method of claim 11, wherein the engine vibration signal is generated by one of an engine knock sensor and an accelerometer.

18. The method of claim 11, further comprising processing the engine vibration signal.

19. The method of claim 18, wherein processing the engine vibration signal includes generating a fast Fourier transform (FFT) of the engine vibration signal.

20. The method of claim 19, wherein the frequency of the engine vibration is based on a maximum of the FFT.

* * * * *